US005584677A

United States Patent [19]

Ishikawa et al.

[11] Patent Number: 5,584,677

[45] Date of Patent: Dec. 17, 1996

[54] SCROLL COMPRESSOR HAVING A BEVELLED FACING SECTION

[75] Inventors: Kimihiro Ishikawa, Aichi; Takashi Miyakawa, Kariya; Tetsuhiko Fukanuma, Kariya; Tetsuo Yoshida, Kariya, all of Japan

[73] Assignees: Nippondenso Co., Ltd.; Kabushiki Kaisha Toyoda Jidoshokki Seisakusho, both of Kariya, Japan

[21] Appl. No.: 404,819

[22] Filed: Mar. 14, 1995

[30] Foreign Application Priority Data

Mar. 15, 1994 [JP] Japan ..... 6-044025

[51] Int. Cl.[6] ..... F04C 18/04

[52] U.S. Cl. ..... 418/55.2; 418/178

[58] Field of Search ..... 418/55.1, 55.2, 418/178

[56] References Cited

U.S. PATENT DOCUMENTS

| | | | |
|---|---|---|---|
| 4,579,512 | 4/1986 | Shiibayashi et al. | 418/55.2 |
| 4,666,380 | 5/1987 | Hirano et al. | 418/55.2 |
| 4,824,345 | 4/1989 | Fukuhara et al. | 418/55.2 |
| 4,904,169 | 2/1990 | Ichikawa | 418/55.2 |
| 5,320,505 | 6/1994 | Misiak et al. | 418/55.2 |
| 5,364,247 | 11/1994 | Fukanuma et al. | 418/55.2 |

FOREIGN PATENT DOCUMENTS

| | | | |
|---|---|---|---|
| 60-85285 | 5/1985 | Japan . | |
| 62-199982 | 6/1987 | Japan | 418/178 |
| 63-32992 | 7/1988 | Japan . | |
| 2-146201 | 6/1990 | Japan . | |
| 3-92591 | 4/1991 | Japan | 418/55.2 |

*Primary Examiner*—John J. Vrablik
*Attorney, Agent, or Firm*—Cushman, Darby & Cushman

[57] ABSTRACT

A base plate 41 of a movable scroll member 4 has, at its outer periphery, a section 44 with no scroll wall, while a scroll wall 22 of a stationary scroll member 2 has a section 24 for connecting to an outer cylindrical shell 22. These sections 44 and 24 make a relative lateral slide movement during an orbital movement of the movable scroll member 4 with respect to the stationary scroll member 2. These sections 44 and 24 have axially faced inner and outer edges 44-1 and 24-1, over which the relative lateral movement occurs. These inner and outer edges 44-1 and 24-1 are bevelled, the bevelling being such that any skewed movement of the movable scroll member with respect to the stationary scroll member does not cause locally increased contact pressure, thereby preventing galling as well as seizing.

5 Claims, 10 Drawing Sheets

SCROLL COMPRESSOR HAVING A BEVELLED FACING SECTION

BACKGROUND OF THE INVENTION

1. Field of the Invention

The present invention relates to a scroll compressor which is, for example, used for a refrigerant compressor in refrigerating system.

2. Background of the Invention

Scroll compressors are well known and include, as in, for example, Japanese Un-Examined Patent Publication No. 60-85285, a housing, a stationary scroll member fixedly arranged in the housing, the stationary scroll member having a base plate and a scroll wall extending from the base plate, and a movable scroll member rotatably arranged in the housing at a phase difference of 180 degrees with respect to the stationary scroll member, the movable scroll member having a base plate and a scroll wall extending from the base plate. Furthermore, a drive shaft is rotatably supported with respect to the housing by way of a bearing unit. A drive key is connected at an end of the shaft adjacent the movable scroll member having a boss portion extending from the base plate of the movable scroll member at its side remote from the scroll wall. The drive key is connected to the boss portion of the movable scroll member via a bushing and a radial bearing. A mechanism is arranged between the housing and the base plate of the movable scroll member for preventing the movable scroll member from rotating about its own axis.

In this compressor, the rotating movement of the pin caused by a rotating movement applied to the drive shaft is transmitted to the movable scroll member via the bushing. The self rotation blockage mechanism prevents the movable scroll member from rotating about its own axis. As a result, only an orbital movement of the movable scroll member about the axis of the shaft is obtained. Due to the orbital movement of the movable scroll member, compression chambers formed between the stationary and movable scroll members, which are in mutual engagement, are moved radially inwardly, while their volume is reduced, so that a gaseous refrigerant sucked into the chambers from an intake port is first, compressed and, second, discharged through an outlet port.

In the operation of the scroll compressor, a cantilever arrangement of the movable scroll member eccentric to the drive shaft generates a force which urges the movable scroll member to be skewed with respect to the stationary scroll member about the center of gravity of the movable scroll member due to the fact that the movable scroll member is subjected to a centrifugal force by the orbital movement as well as a compression reaction force by the refrigerant gas being compressed in the chamber. Due to an assembly tolerance for allowing the movable scroll member to be assembled to the stationary scroll member, an axial gap between the stationary and movable scroll members, and a radial gap due to the radial bearing between the movable scroll member and the drive pin, are inevitably created. The existence of such gaps allows the movable scroll member to be slightly inclined with respect to the axis of the shaft when the above mentioned skewing force is generated, thus causing the movable and stationary scroll members to be locally contacted with each other, thereby causing galling or seizing within the pump.

In a type of the scroll compressor where the stationary scroll member is fixedly arranged inside the housing, the skewed movement of the movable scroll member is likely to cause locally increased contacting pressures. Such increased contacting pressures can occur especially at locations between an outer edge at a section of the base plate of the movable scroll member without a scroll wall and an inner edge of the scroll wall of the stationary scroll member at a section where the scroll wall is connected to the housing. Namely, at these locations, a relative lateral movement between the inner and outer scrolls occurs. The skewed arrangement of the movable scroll member with respect to the stationary scroll member subjects the inner and outer edges to an increased contact force, thereby causing galling or seizing. In this situation, prolonged operation of the compressor under a high compression may damage the movable scroll member or the housing or the stationary scroll member connected to the housing.

In this type of scroll compressor, the Japanese Examined Patent Publication No. 63-32992 or Unexamined Patent Publication Number 2-146201 proposes a construction for obtaining both low weight and low friction wherein one of the stationary scroll member and the movable scroll member is made of a soft material such as an aluminum based alloy, while the other one is made of a hardened material such an aluminum based alloy with alumite treatment. In such a construction of a scroll compressor, skewed movement of the movable scroll member with respect to the stationary scroll member may make it more easy to generate galling and seizing.

SUMMARY OF THE INVENTION

An object of the present invention is to provide a scroll compressor capable of preventing damage to the stationary and/or movable scroll members irrespective of a skewed movement of the movable scroll member with respect to the stationary scroll member.

According to the present invention, a scroll compressor is provided, comprising:

a housing;

a drive shaft having an axis of rotation;

a stationary scroll member which is in a fixed relationship with respect to the housing, the stationary scroll member including a base plate and a scroll wall extending integrally from the base plate;

a movable scroll member including a base plate and a scroll wall extending integrally from the base plate;

the movable scroll member being arranged eccentrically with respect to the stationary scroll member so that a plurality of chambers are created between the scroll members;

means for connecting the movable scroll member with respect to the drive shaft so as to obtain an orbital movement of the movable scroll about the axis of rotation of the drive shaft;

means for preventing the movable scroll member from rotating about its own axis, so that the orbital movement of the movable scroll member allows the chambers to be moved radially from an outward position to an inward position;

an intake means for introduction of a medium to be compressed into a chamber that is located at the radially outward position, and;

a discharge means for discharging the medium as compressed from a chamber that is located at a radially inward position;

the base plate of the movable scroll member having, at its outer periphery, a section with no scroll wall, and the scroll wall of the stationary scroll member having an area for connecting the scroll wall with the housing, wherein a portion of the area for connecting the scroll wall with the housing of the stationary scroll member is in axial contact with the section of the base plate of the movable scroll member having no scroll wall, the axial contact occurring at a circumferential position which causes the movable scroll member to be skewed with respect to the stationary scroll member;

the axially contacting sections of the base plate of the movable scroll member and the scroll wall of the stationary scroll member having edges which face each other;

wherein during the orbital movement of the movable scroll member, the axially contacting sections are moved laterally with respect to each other, while a relative position between the edges is varied;

at least one of the edges at the axially contacting sections being bevelled, the degree of the bevelling being larger than at the remaining portions of the scroll members, such that, during the lateral relative movement between the sections via the edges, a locally increased pressure is not generated irrespective of the axial skewing of the movable scroll member with respect to the stationary scroll member.

BRIEF EXPLANATION OF ATTACHED DRAWINGS

Figure 12:
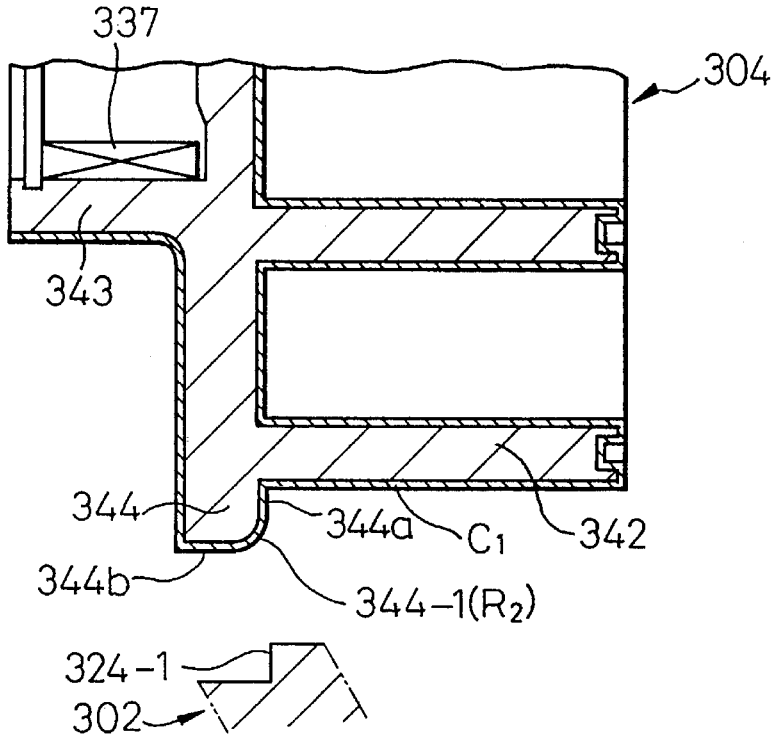
Figure 13:
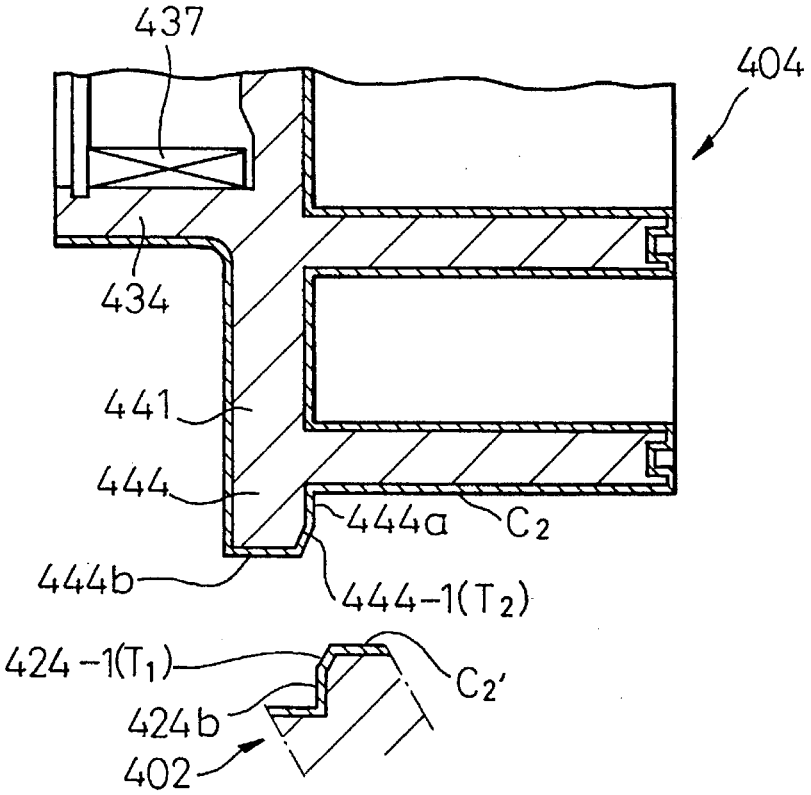

FIGS. 12 and 13 respectively show modifications of the present invention.

DESCRIPTION OF PREFERRED EMBODIMENT

The embodiments of the present invention will be explained with reference to attached drawings.

In the first embodiment shown by FIGS. 1 to 7, a scroll compressor includes compression chambers 1, and stationary and movable scroll members 2 and 4, respectively, between which the compression chambers 1 are created. The stationary scroll member 2 has a base plate 21 of a disk shape, an outer shell portion (housing) 22 of a tubular shape formed integrally with respect to the base plate 21 and a scroll wall 23 of a desired scroll shape, such as an involute curve, also formed integrally with respect to the base plate 21. The movable scroll member 4 has a base plate 41 of a disk shape and a scroll wall 42 of a desired scroll shape, such as an involute curve, formed integrally with respect to the base plate 41. The stationary and movable scroll members 2 and 4 are under axial and radial contact conditions such that axial ends of the scroll walls 23 and 42 contact axially with the base plates 41 and 21, respectively, and such that the scroll walls 23 and 42 contact radially with each other, so that the compression chambers 1 are formed between the base plates 21 and 41 and the scroll walls 23 and 42 of the scroll members 2 and 4.

A tip seal member 10 made of PTFE (polytetrafluoroethylene) is arranged between the faced surfaces of the scroll wall 23 of the stationary scroll member 2 and the base plate 41 of the movable scroll member 4. Similarly, a tip seal member 11, made of PTFE, is arranged between the faced surfaces of the scroll wall 42 of the movable scroll member 4 and the base plate 21 of the stationary scroll member 2.

The stationary and movable scroll members 2 and 4 are both made from an aluminum alloy.

Figure 2:
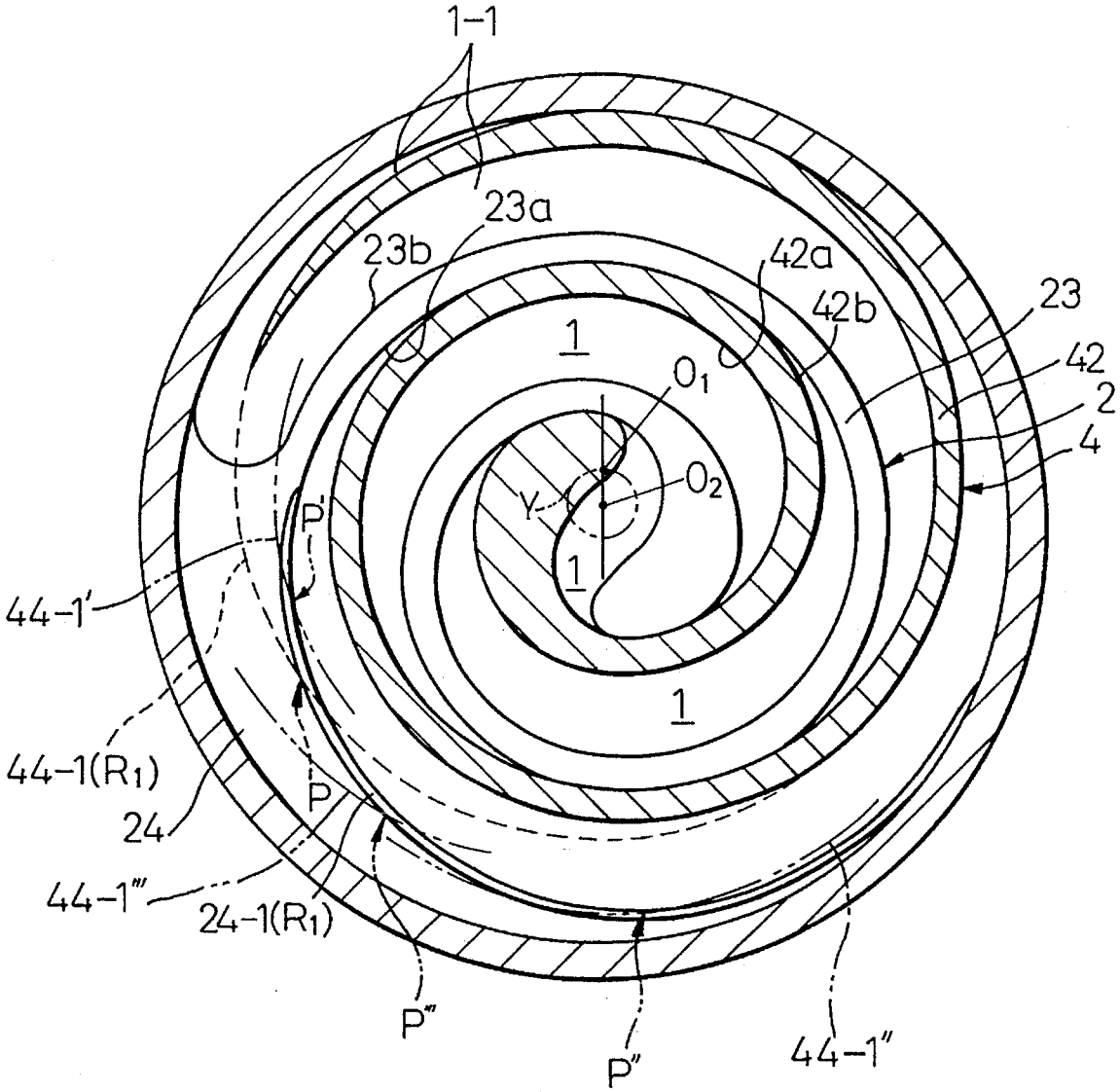
FIG. 2 is a transverse cross section along the line II—II in FIG. 1.

In FIG. 2, the compression chambers 1 are radially spaced and move radially inwardly to reduce the volume of the chambers so that compression of the refrigerant occurs in the pump chambers 1.

Figure 1:
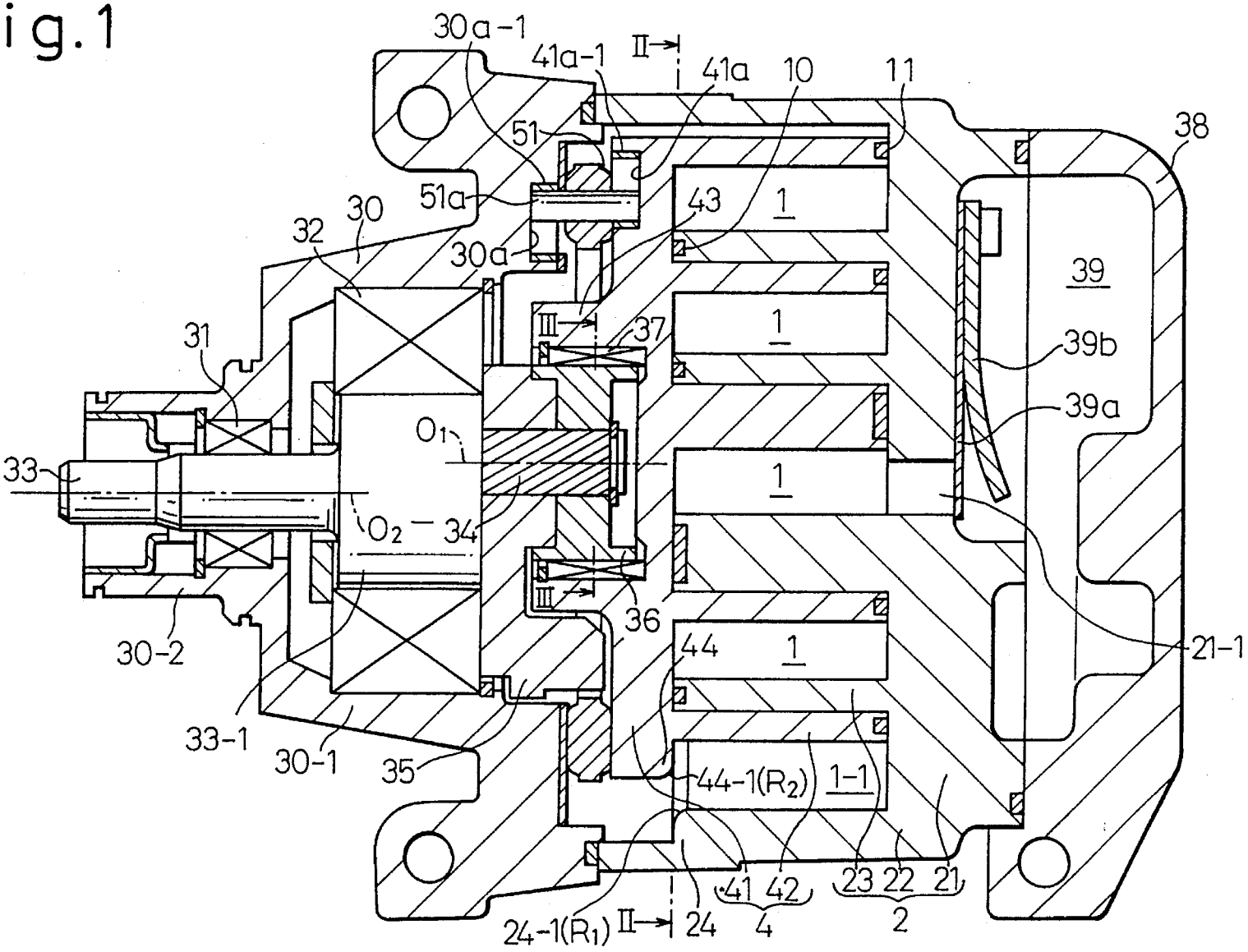
FIG. 1 is a longitudinal cross section of the scroll compressor according to the present invention.
Figure 3:
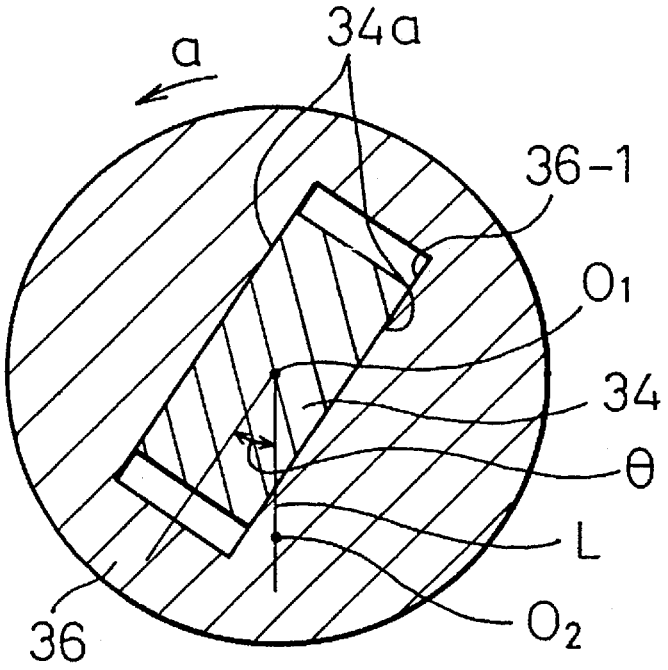
FIG. 3 is a transverse cross section along the line III—III in FIG. 1.

As shown in FIG. 1, a front housing 30 and a rear housing 38 are connected to the shell portion 22 and the base plate portion 21 of the stationary scroll member 2 by a suitable means such as bolts and nuts. The front housing 30 has a radially outer tubular boss portion 30-1 and a radially inner tubular boss portion 30-2. A drive shaft 33 has an increased diameter portion 33-1, which is inserted to a main bearing unit 32, which is housed in a space inside the outer boss portion 30-1, so that the drive shaft 33 is rotatably supported by the housing 30. A shaft seal unit 31 is arranged inside the boss portion 30-2 to seal the lubricant oil included in the refrigerant to be compressed. A drive key 34 having radially spaced drive surfaces **34*a* (FIG. 3) is integrally formed on one end of the increased diameter portion 33-1 of the drive shaft 33 at a location which is eccentric with respect to the axis of the shaft 33. The key 34 is slidably inserted into a drive bushing 36 and a counter weight 35. As shown in FIG. 3, the drive bushing 36 is formed with a bore 36-1, which defines a pair of spaced drive surfaces with which the drive key is, at its drive surfaces 34*a*, in a face to face contact condition. As a result, the rotating movement of the shaft 33 is transmitted to the drive bushing 36, while allowing the drive bushing 36 to be moved radially with respect to the drive key 34. Furthermore, the drive key 34 is inclined rearwardly with respect to the line L connecting the axis $O_1$ of the movable scroll member 4 and the axis $O_2$ of the shaft 33 in the direction opposite to the direction of the rotation of the shaft 33 as shown by an arrow a for an angle of θ. This arrangement constitutes a so-called follower crank mechanism for allowing the movable scroll member 4 to be radially contacted with the stationary scroll member 2** by a compression force.

As shown in FIG. 1, the base plate 41 of the movable scroll member 4 is, at its end remote from the scroll wall 42, formed with an axially extending tubular boss portion 43. A bearing 37 is arranged in the boss portion 43 for rotatably supporting the bushing 36. As a result, an orbital movement of the rotary scroll member 4 about the axis $O_2$ of the shaft 33 is obtained, while a radial movement of the rotary scroll member 4 is allowed by means of the key 34 engaging the groove 36-1 in the bushing 36.

A self rotation blocking mechanism, for blocking the rotation of the movable scroll member 4 about its own axis, is provided. The mechanism includes a movable ring 51, which is arranged between the front housing and the base plate 41 of the movable scroll member 4. A plurality of circumferentially spaced self rotation blockage pins 51*a* are fitted to the movable ring 51. The front housing 30 is, at its end surface opposite to the base plate 41, formed with a plurality of circumferentially spaced circular recesses 30*a* with ring shaped liners 30*a*-1, while the base plate 41 is, at its end surface opposite the housing 30, formed with a plurality of circumferentially spaced circular recesses 41*a* with ring shaped liners 41*a*-1. As a result, a plurality of axially opposite pairs of the recesses 30*a* and 41*a*, of the same number as that of the pins 51*a*, are created in such a manner that, in each of the pairs of the recesses 30*a* and 41*a*, a pin contacts, at its diametrically opposite locations, with the liners 30*a*-1 and 41*a*-1 in the recesses 30*a* and 30*b*. Such a structure of the circumferentially spaced pins 51*a* allows the movable scroll member 4 to be supported radially, by the housing 30, at a plurality of circumferentially spaced locations, which prevents the movable scroll member 4 from being rotated about its own axis $O_1$. As shown in FIG. 2, the front housing 30 is formed with an inlet port (not shown) which is opened, via openings in the movable ring 51, to intake chambers 1—1 which are located at their radially outward positions, i.e., before the closed chamber 1 is created.

As shown in FIG. 1, an outlet chamber 39 is formed between the base plate 21 of the stationary scroll member 2 and the rear housing 38, and is connected to the refrigerating system (not shown) condenser. A valve unit, which is constructed by a valve member 39*a* as a reed valve and a stopper plate 39*b* for preventing the valve member 39*a* from buckling, is arranged in the outlet chamber 39. Furthermore, the base plate 21 has an outlet port 21-1, which is usually closed by the valve member 39*a* due to its resiliency. A high pressure in the pump chamber 1, when is it moved into a radially inward position, causes the valve member 39*a* to be displaced from the outlet port 21-1, so that the compressed refrigerant is discharged, via the outlet chamber 39, into the refrigerating system (not shown).

Figure 4:
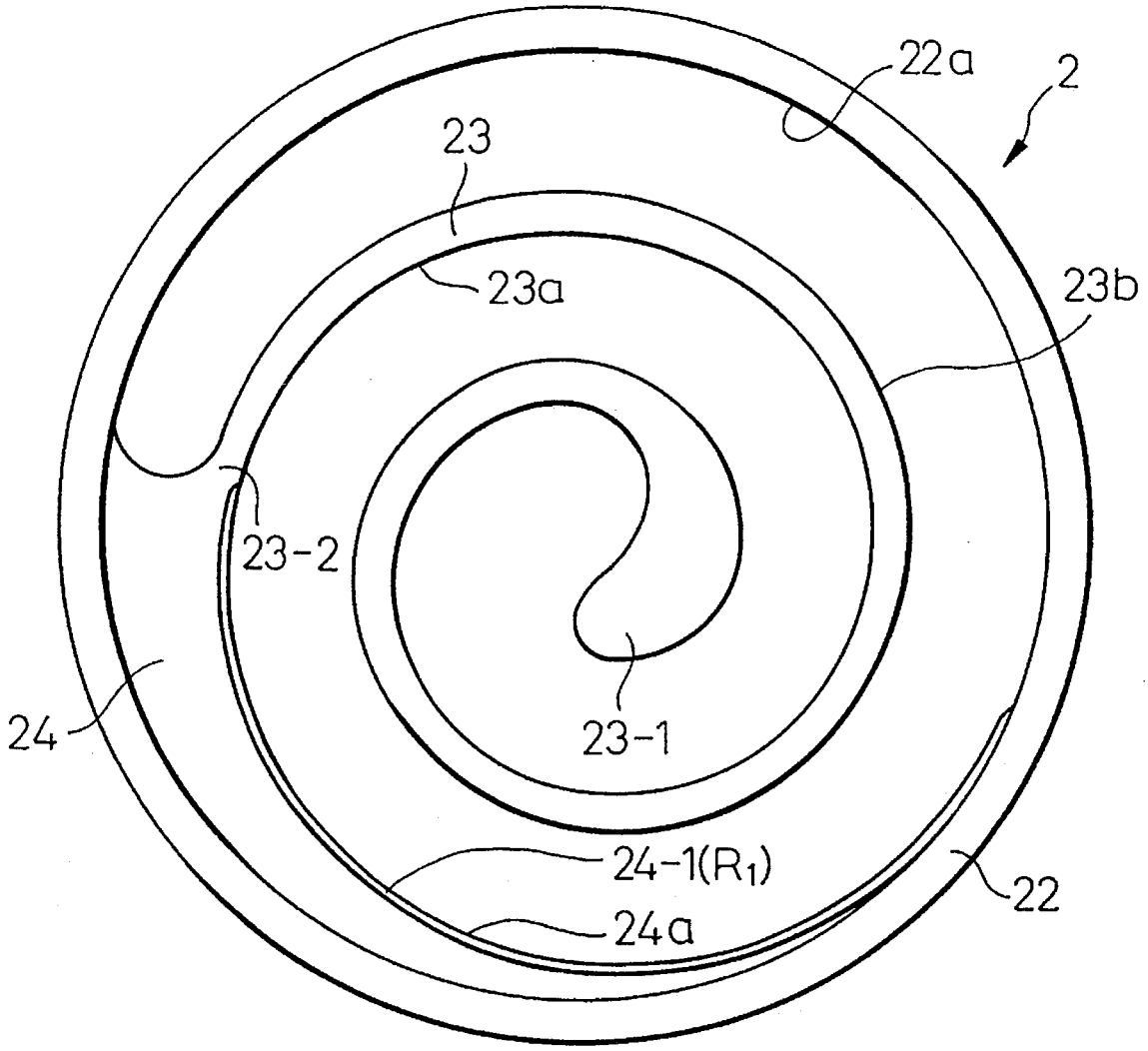
FIG. 4 is a front view of the stationary scroll member in FIG. 1.
Figure 5:
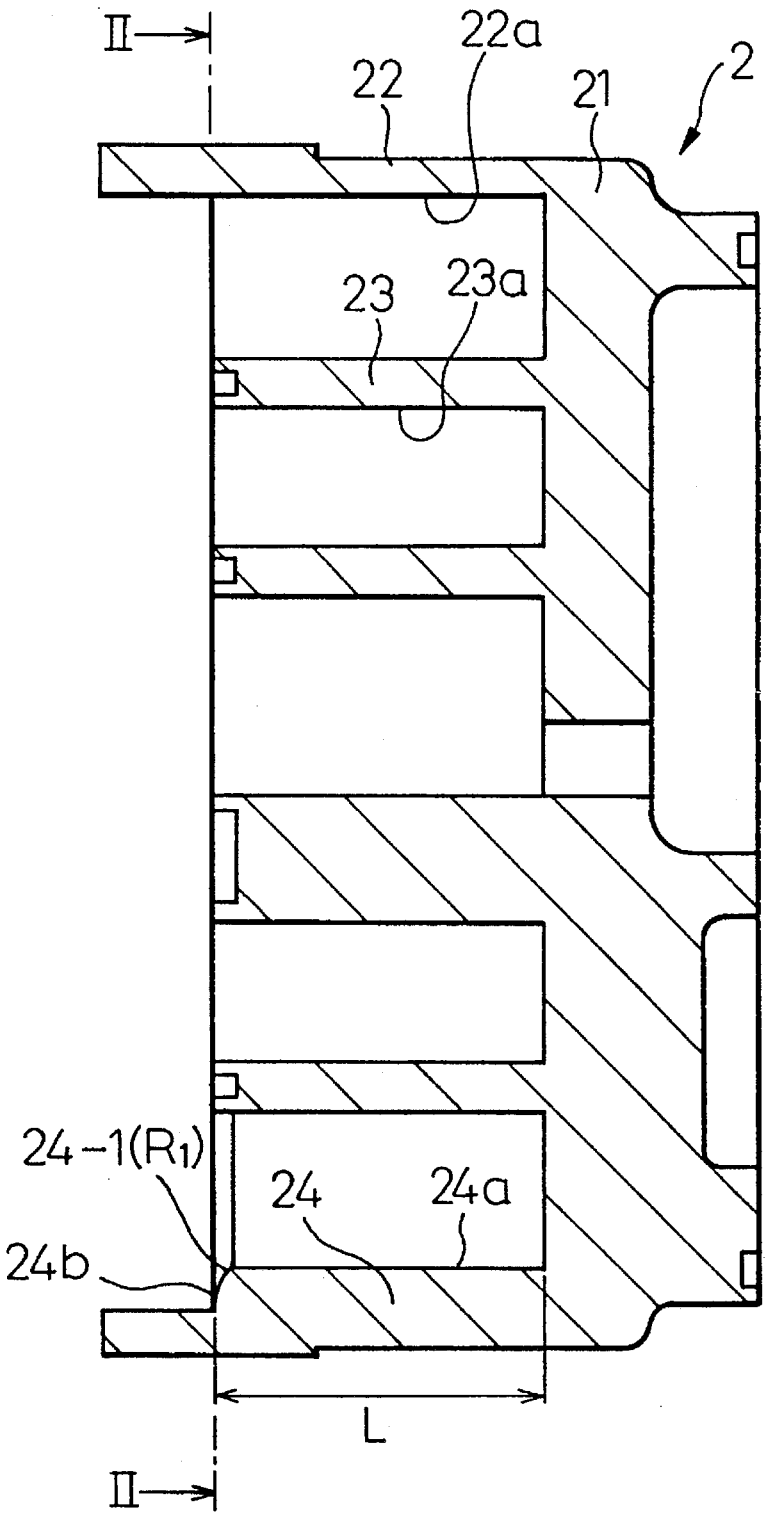
FIG. 5 is a longitudinal cross sectional view of the stationary scroll member in FIG. 4.

As shown in FIG. 4, in the stationary scroll member 2, the scroll wall 23 has, along its spiral direction, an inner end 23-1 and outer end 23-2, which is connected, via a transient section 24, to the shell 22. The transient section 24 is of the same axial length (L) as that of the scroll wall 23 of the stationary scroll member 2, as shown in FIG. 5, and forms an inner scroll surface 24*a* as an extension of an inner surface 23*a* of the scroll wall 23. The inner surface 24*a* is connected to an inner surface 22*a* of the shell 22. Thus, an entire shape of the involute curve is formed by the surfaces 23*a*, 24*a* and 22*a*. The scroll wall 23 has an outer surface 23*b*. The section 24 has an axial end surface 24*b* (FIG. 5), which is co-planar with respect to the end axial end surface of the scroll wall 23, which is in face to face contact with the base plate 41 of the movable scroll member. Furthermore, at the section 24, an inner edge 24-1 is formed at a location where the surface 24*a* and 24*b* are connected, as shown in FIG. 5.

Figure 6:
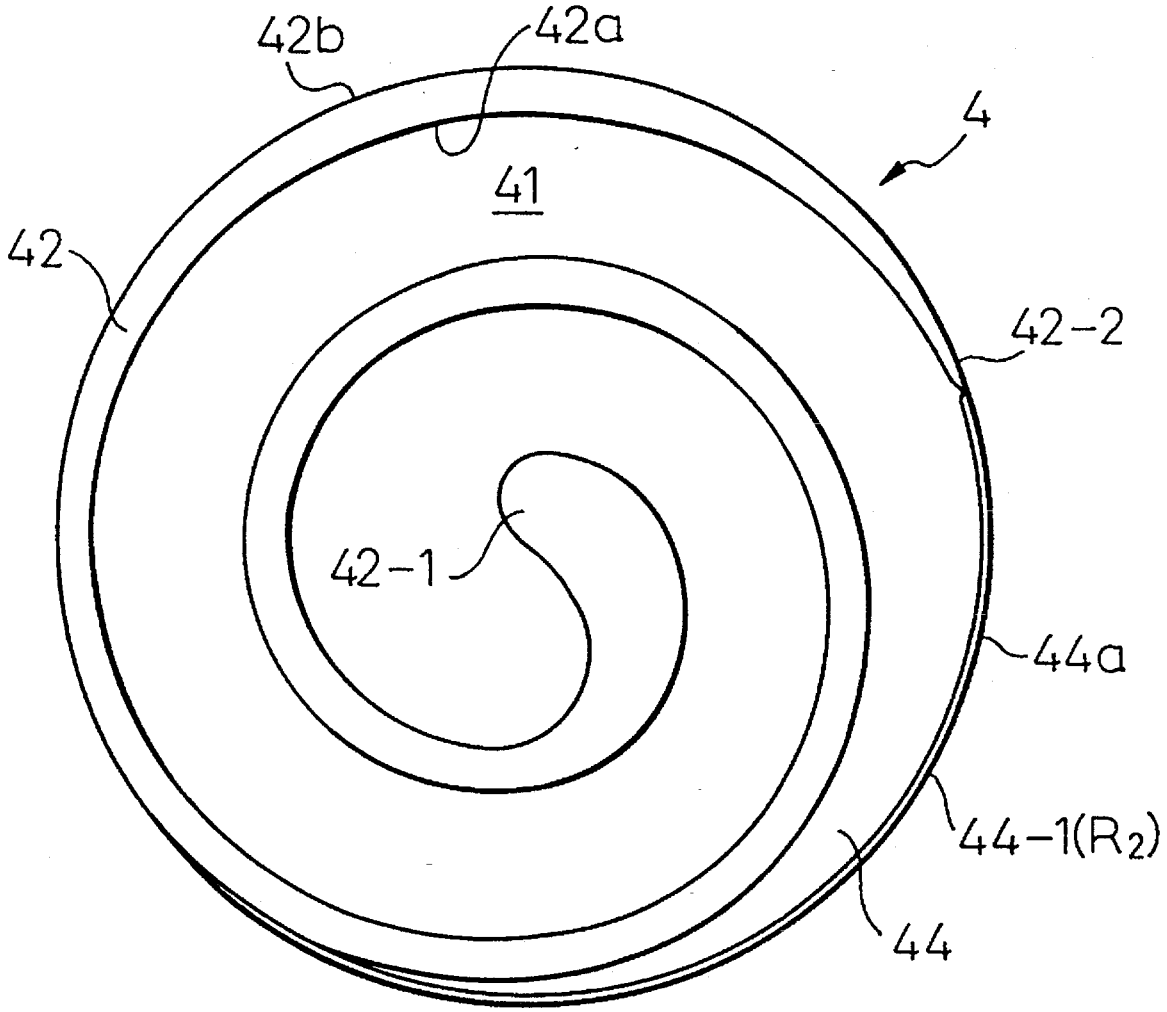
FIG. 6 is a front view of the movable scroll member in FIG. 1.
Figure 7:
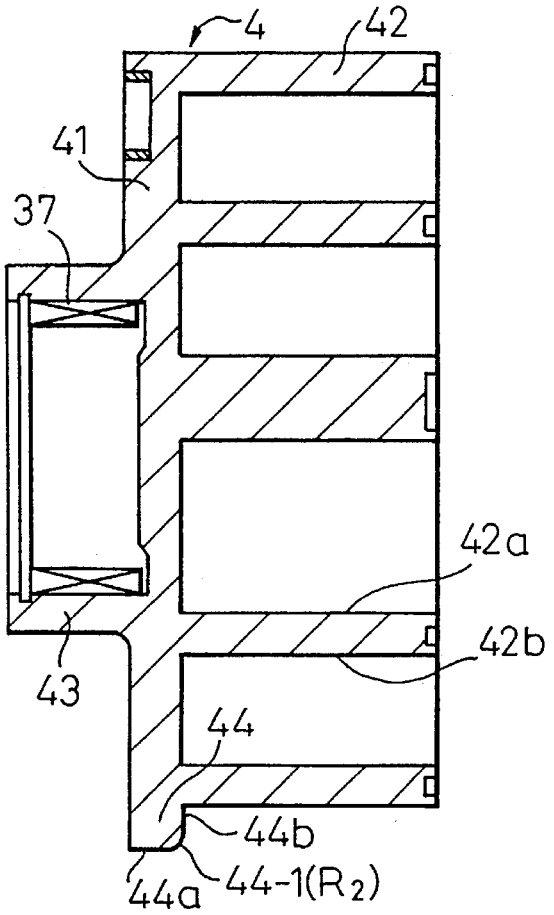
FIG. 7 is a longitudinal cross sectional view of the movable scroll member in FIG. 6.

As shown in FIG. 6, in the movable scroll member 4, the scroll wall 42 forms an inner and outer surface 42*a* and 42*b*, and has an inner end 42-1 and an outer end 42-2 located at an outer periphery of the base plate 41. Thus, along the outer periphery of the base plate 41, the movable scroll member forms an outer plate section 44, which is lacking in the scroll wall 42. Thus, the outer plate section 44 is formed with a surface 44*b* (FIG. 7) which is co-planar with the surface of the base plate 41, faced with the scroll wall 23 of the stationary scroll member 2. Furthermore, at the section 44, an outer edge 44-1 faced with the edge 24-1 of the stationary scroll member is formed at a location where the surface 44*a* and 44*b* are connected, as shown in FIG. 7.

In FIG. 2, the arrangement between the stationary and movable scroll members is shown when they are in an assembled condition. The axis of the stationary scroll member 2 is designated by $O_2$, while the axis of the movable scroll member 4 is designated by $O_1$. A trajectory of the orbital movement of axis $O_1$ of the movable scroll member 4 is designated by a circle Y. During the orbital movement of the movable scroll member 4, the movable scroll member 4 maintains its contact with the stationary scroll member 2 not only at their circumferential surfaces (23*a* and 42*b*, and 23*b* and 42*a*) of the scroll walls 23 and 42 but also at the axial surfaces between the axial end surfaces of the scroll walls and the faced surfaces of the base plates 21 and 41. An axial contact is also obtained between the transient section 24, as an extension of the scroll wall 23, and the outer plate portion 44 of the base plate lacking in the scroll wall 42. During the orbital movement of the movable scroll member 4, the mutual sliding contact between these sections 24 and 44 of the scroll members 2 and 4 is maintained. However, as to the edges 24-1 and 44-1 of the sections 24 and 44, the location of the contact between the edges 24-1 and 44-1 changes in accordance with the orbital movement. Namely, in FIG. 2, the location of the contact of the edges 24-1 and 44-1 is designated by a point P, which is displaced in accordance with the orbital movement of the movable scroll member 4. In FIG. 2, during an orbital movement, 44-1', 44-1" and 44-1"' show different locations of this section 44, while P', P" and P"' show the respective locations of the point of contact of the edge 44-1 with the edge 24-1 of the transient section 24 of the stationary scroll member 2.

According to the present invention, as shown in a longitudinal cross sectional shape of the stationary scroll member 2 in FIG. 5, the edge 24-1 of the portion 24 is bevelled at a radius of $R_1$. Similarly, as shown in a longitudinal cross sectional shape of the movable scroll member 4 in FIG. 7, the edge 44-1 of the portion 44 is bevelled at a radius $R_2$. It is quite usual that a small degree of bevelling is also provided at remaining portions of the scroll members 2 and 3. However, the degree of the bevelling (radius $R_1$ and $R_2$ of the edges) at the edges 24-1 and 44-1 which are axially faced is larger than those at the remaining portions. These bevels are for preventing galling or seizing during the orbital movement of the movable scroll member with respect to the stationary scroll member, as will be described fully later.

The stational scroll member 2 and movable scroll member 4 are made by molding, which is followed by machining the scroll walls 23 and 42. After the machining, pressing is done to obtain the above mentioned bevelled portions ($R_1$ and $R_2$).

During the operation of the scroll compressor according to the present invention, the rotational movement from a rotating movement source, such as a crankshaft of an internal combustion engine, is transmitted to the drive shaft 33 via an electromagnetic clutch (not shown). The rotating movement of the shaft 33 causes the bushing 36 to be rotated via the key 34, so that an orbital movement of the movable scroll member 4 along the trajectory Y (FIG. 2) is obtained about the axis $O_2$ of the shaft 33, while the self-rotating blockage mechanism constructed by the ring 51 and the pins 51*a* prevents the movable scroll member from being rotated about its own axis $O_1$. Due to such an orbital movement, each of the compression chambers 1 are moved radially inwardly from an outer position which is in communication with the intake port to an inner position which is in communication with the outlet port 21-1. As each compression chamber 1 moves radially inwardly, its respective volume is reduced, so that the refrigerant in the chamber is finally discharged into the outlet chamber 39 via the reed valve 39*a*.

Figure 8:
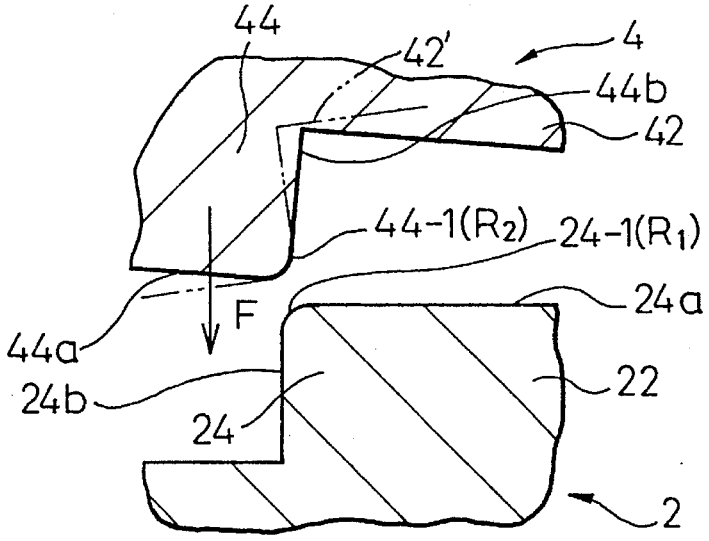
FIG. 8 is an enlarged partial view of FIG. 1, illustrating the relationship between the facing edges of the scroll members.

During such an operation of the scroll compressor, the centrifugal force and the compression reaction force urge the movable scroll member 4 to be rotated about the center of the gravity due to the fact that the movable scroll member is supported only at one end, i.e., the bearing unit 37. Furthermore, an inevitable tolerance may generate an axial gap between the stationary and movable scroll members 2 and 4 and a radial gap of the radial bearing with respect to the movable scroll member and the drive key 34. As a result, above mentioned forces cause the movable scroll member to be skewed with respect to the longitudinal axis. FIG. 8 schematically illustrates a condition where the movable scroll member 4 is skewed with respect to the stationary scroll member 2. The provision of the bevelled edges 24-1 and 44-1 of an increased radius R1 and R2 allow the edges to be brought into mutual engagement, without generating any galling or seizing. Namely, during the orbital movement of the movable scroll member 4 with respect to the stationary scroll member, a mutual lateral movement occurs between the section 24 of the stationary scroll member 2 and the section 44 of the movable scroll member 4 via the inner edge 24-1 and the outer edge 44-1. The direction of such a mutual lateral movement is designated by an arrow F in FIG. 8. Namely, in FIG. 2, during the orbital movement of the movable scroll member 4, with respect to the inner edge 24-1 of the section 24 of the movable scroll member 4, the outer edge of the outer plate section 44 of the stationary scroll member 2 moves as shown by 44-1, 44-1', 44-1" or 44-4"' in FIG. 2. In other words, the point of the contact between the edges 24-1 and 44-1 is varied as shown by P, P', P" or P"'. The provision of the rounded edges 24-1 and 44-1 at the portions 24 and 44, respectively, allows the mutual lateral movement to smoothly take place. Namely, the contact between the edges 24-1 and 44-1 takes place without generating an excessive force, thereby preventing galling or seizing from occurring. Such an advantage is also obtained when the movable scroll member is skewed in the opposite direction as shown by a dotted line 42' in FIG. 8. Even in the situation that the movable scroll member effects an oscillation between the solid line and phantom lines in FIG. 8, the bevelling R1 and R2 allow the edges 24-1 and 44-1 to be smoothly brought into a mutual engagement, thereby preventing galling, as well as seizing, from occurring.

Figure 9:
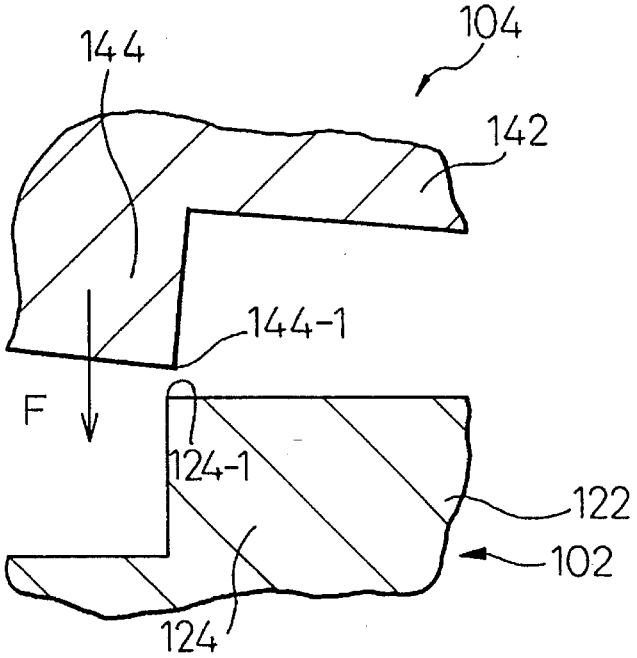
Fig.9 PRIOR ART
FIGS. 9 and 10 are similar to FIG. 8 but illustrate an arrangement in the prior art.
Figure 10:
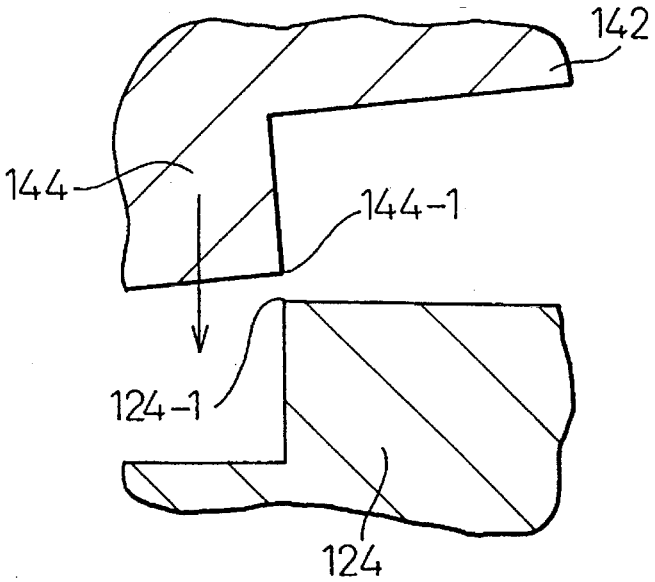
Fig.10 PRIOR ART

An advantage of the present invention over the prior art is as follows. Namely, FIG. 9 or 10 is similar to FIG. 8 but illustrates an arrangement in the prior art. For similar parts, the same reference numerals are used after the addition of 100 to each numeral. In FIG. 9, the movable scroll member 104 is skewed in one direction with respect to the stationary scroll member 102, while, in FIG. 10, the movable scroll member 104 is skewed in the opposite direction with respect to the stationary scroll member 102. In the prior art, the edge portion 124-1 of a section 124 of a stationary scroll member 102 as well as the edge portion 144-1 of a section 144 of a movable scroll member 104 are sharp. As a result, during a lateral mutual movement, as shown by the arrow F, between the stationary scroll member 102 and the movable scroll member 104 caused the orbital movement of the movable scroll member 104, a locally increased contact force may be generated between the edges 124-1 and 144-1, thereby causing galling and/or seizing.

Due to the reduced interference between the edges 24-1 and 44-1 of the scroll members 2 and 4 according to the present invention, a prolonged service life of the compressor under an increased rotational speed and compression pressure is achieved. This is the case even if the scroll members 2 and 4 are made from a soft material, such as an aluminum based alloy, which achieves the advantage of a low weight of the compressor.

Figure 11:
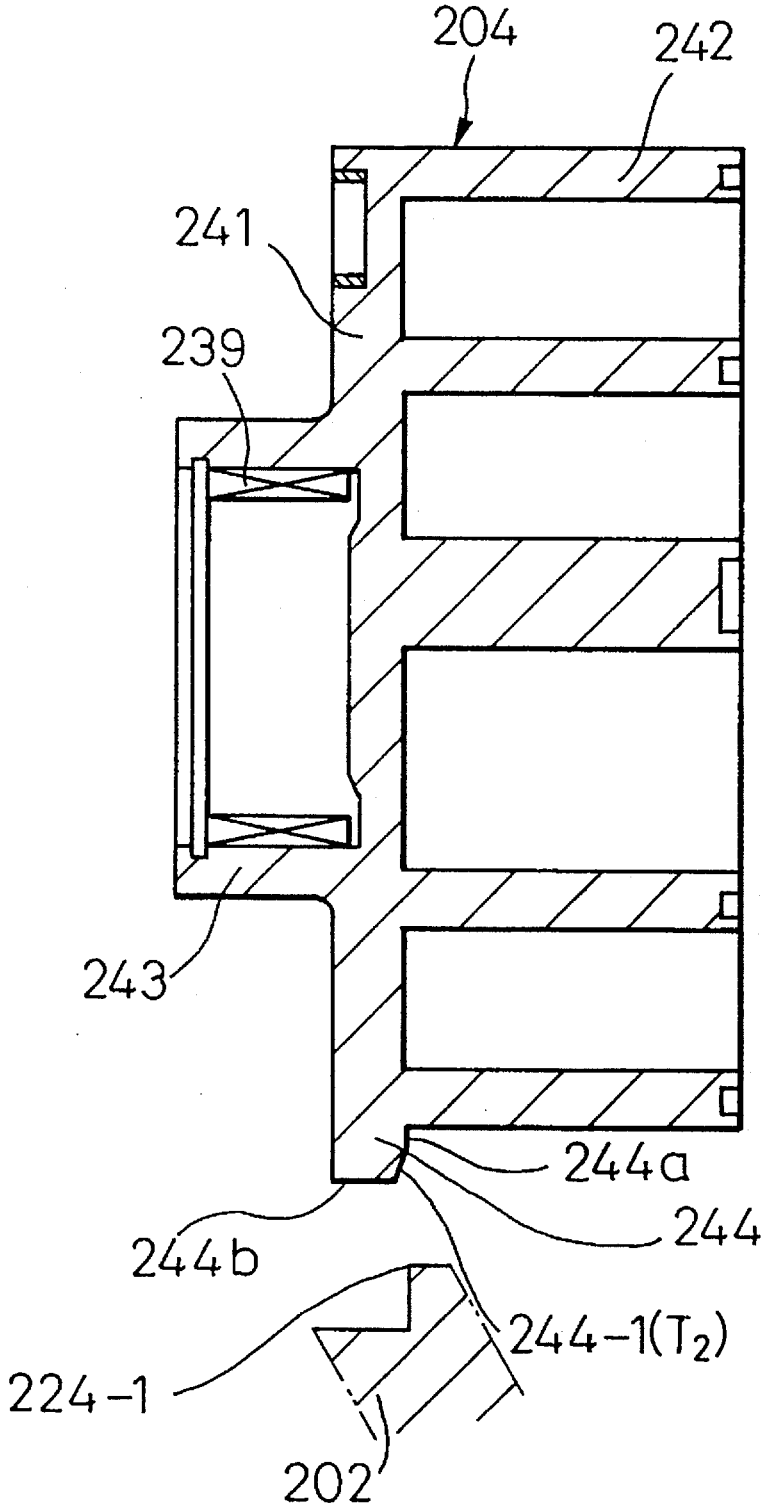
FIG. 11 is similar to FIG. 7 but illustrates a modification of the present invention.

FIG. 11 is similar to FIG. 7, but shows a second embodiment of the present invention, where, for the similar parts, the same reference numerals, each increased by 200, are used. In FIG. 11 the bevelling at the edge portion 244-1 is not a rounded one as is the case in the first embodiment but is a plain one. Namely, the bevelled portion forms, in cross section, a straight inclined line $T_2$, the inclination of which is as large as possible on the side of the end surface 244*a* facing the stationary scroll member 202. With regard to the stationary scroll member 202, the edge 224-1 is shown not bevelled, so that the edge remains relatively sharp.

FIG. 12 shows a third embodiment, where, for the similar parts, the same reference numerals, each increased by 300, are used. In FIG. 12, the movable scroll member 304 is, along the entire surface thereof, formed with a layer C1 made of a hardened alumite. Furthermore, an inner edge 344-1 of an outer plate section 344 is bevelled to obtain a radius of R2. As to the stationary scroll member 302, it is made from an aluminum alloy with no hard coating layer. Furthermore, the inner edge 324-1 is not bevelled.

In this embodiment, the movable scroll member 304 is, along the entire surface, including the rounded outer edge 344-1, formed with a layer C1 of a hardened alumite. As a result, the layer C1 can contact with the stationary scroll member at a reduced face to face contact pressure, thereby obtaining a smooth sliding movement between the movable and stationary scroll members.

FIG. 13 shows a fourth embodiment, where, for the similar parts, the same reference numerals, each increased by 400, are used. In FIG. 13, the movable scroll member 404 is, along the entire surface thereof, formed with a hard layer $C_2$ as a non-electrolyte plating of Ni-P. Similar to the embodiment in FIG. 11, an outer edge 444-1 facing the movable scroll member 402 is bevelled by a tapered plane $T_2$. Namely, the bevelling forms, in a cross section, a straight inclined line, the inclination of which is as large as possible on the rear surface 444*a*. The stationary scroll member 402 is also formed with a hard layer $C_2'$ as a non-electrolyte plating of Ni-P. At the inner edge 424-1 of the stationary scroll member facing the edge 444-1, a plane bevelling $T_1$ is also provided, so that an inclination of the plane is as large as possible at the front end surface 424*b*. As with the faced inner edge of the stationary scroll member, the bevelling $T_1$ and $T_2$ can be done by stamping or pressing.

In the above embodiments of the present invention, as shown in FIG. 6, the scroll wall 42 is located on the base plate in such a manner that the outer wall 42*b* of the scroll wall 42 partly corresponds to the outer peripheral wall (44*a*) of the base plate 41. However, another construction of the movable scroll member can be employed where the outer peripheral scroll wall is always spaced from the outer peripheral wall of the base plate.

Furthermore, in the shown embodiment, the shell portion 22 of the stationary scroll member forms a housing of the scroll compressor. However, another construction can be employed, where the stationary scroll member is made separate from a housing, to which the separate stationary scroll member is fixedly connected.

While the embodiments of the present invention are explained with reference to the attached drawings, many modifications and changes can be made by those skilled in this art without departing from spirit and scope of the present invention.

We claim:

1. A scroll compressor comprising:

a housing;

a drive shaft having an axis of rotation;

a stationary scroll member which is under a fixed relationship with respect to the housing, the stationary scroll member including a base plate and a scroll wall extending integrally from the base plate;

a movable scroll member including a base plate and a scroll wall extending integrally from the base plate;

the movable scroll member being arranged eccentrically with respect to the stationary scroll member so that a plurality of chambers are created between the scroll members;

means for connecting the movable scroll member to the drive shaft so as to obtain an orbital movement of the movable scroll about the axis of rotation of the drive shaft;

means for preventing the movable scroll member from rotating about its own axis, so that the orbital movement of the movable scroll member allows the chambers to be moved radially from an outward position to an inward position;

an intake means for introducing a medium to be compressed into a chamber that is located at the radially outward position, and;

a discharge means for discharging the medium as compressed from a chamber that is located at the radially inward position;

the base plate of the movable scroll member having, at its outer periphery, a section with no scroll wall, and the scroll wall of the stationary scroll member having an area for connecting the scroll wall with the housing, wherein a portion of the area for connecting the scroll wall with the housing of the stationary scroll member is in axial contact with the section of the base plate of the movable scroll member having no scroll wall, the axial contact occurring at a circumferential position which causes the movable scroll member to be skewed with respect to the stationary scroll member;

the axially contacting sections of the base plate of the movable scroll member and the scroll wall of the stationary scroll member having outer and inner edges, respectively, which face each other;

wherein, during the orbital movement of the movable scroll member, said axially contacting sections move laterally with respect to each other, while the relative position between the edges is varied;

at least one of the edges at the axially contacting sections being bevelled, the degree of the bevelling being larger at the axially contacting sections than at the remaining portions of the scroll members, such that, during said lateral relative movement between the sections via the edges, a locally increased pressure is not generated irrespective of the axial skewing of the movable scroll member with respect to the stationary scroll member.

2. A scroll compressor according to claim 1, wherein the bevelling is formed on the edge of the movable scroll member.

3. A scroll compressor according to claim 1, wherein the bevelling is formed on the edge of the stationary scroll member.

4. A scroll compressor according to claim 1, wherein the bevelling is formed on the edge of the movable and the stationary scroll members.

5. A scroll compressor according to claim 1, wherein the scroll members are formed of aluminum based alloy, and the scroll member formed with the bevelled edge is provided with a coating made of a hard material.

* * * * *